US005146644A

United States Patent [19]

Crocco

[11] Patent Number: 5,146,644

[45] Date of Patent: Sep. 15, 1992

[54] PIPELINE CLEANING DEVICE

[76] Inventor: Domenic C. Crocco, 1656 40th Ave., Vero Beach, Fla. 32960

[21] Appl. No.: 727,864

[22] Filed: Jul. 10, 1991

[51] Int. Cl.[5] ..... B08B 9/02

[52] U.S. Cl. ..... 15/104.12; 15/104.31

[58] Field of Search ..... 15/104.05, 104.061, 15/104.12, 104.31

[56] References Cited

U.S. PATENT DOCUMENTS

| | | | |
|---|---|---|---|
| 1,696,677 | 12/1928 | Hayton | 15/104.12 |
| 2,201,680 | 5/1940 | Haynes | 15/104.31 |
| 4,027,349 | 6/1977 | Clavin | 15/104.12 |

*Primary Examiner*—Edward L. Roberts
*Attorney, Agent, or Firm*—Carroll F. Palmer

[57] ABSTRACT

An improved device for periodic cleaning of large diameter, cylindrical pipelines to remove from their inside wall marine growths or other deposits that implede liquid flow has a central shaft from which struts extend to carry wheels that run along the inside wall of the pipeline is disclosed. Rotor blades are carried on the front end of the shaft and function to drive cutter blades or crusher rollers over the inside wall of the pipeline to remove the impeding deposits. The device moves through the pipeline while water flows therein under control of a line fastened to the rear end of the shaft.

6 Claims, 3 Drawing Sheets

PIPELINE CLEANING DEVICE

BACKGROUND OF THE INVENTION

1. Field of the Invention

This application relates to pipeline cleaning devices. More particularly, it concerns devices for removing from the inside wall of large diameter, cylindrical pipelines barnacles, mussels, oysters, algae and like marine growths or any other deposits that impede liquid flow through the pipelines.

2. Description of the Prior Art

Large diameter, cylindrical pipelines that transport water containing (a) marine life that become attached and grow on the inside surface, and/or (b) salts or other materials that may form crusts on such surface that impede liquid flow exist in many different environments, e.g., electric power plant water intake pipes, wastewater plant effluent discharge pipes, etc. Such flow impediment deposits must be periodically removed to restore the liquid flow capacity of such pipelines to acceptable levels.

One method of removal of such pipeline deposits has been to send scuba divers equipped with hand operated tools into the pipeline to chip and scrape the deposits from the pipeline inner wall. Such cleaning methods are highly labor intensive and generally require shutdown of the pipeline during the cleaning operation.

Another method of removal of large pipeline deposits involves use of hydraulic operated hull cleaners by scuba divers. However, the use of this type equipment on inside curved surfaces is very hazardous, time consuming and costly.

A further prior deposit removal method involves the use of high pressure (10,000 psi) water jets on what is known in the trade as a jet sled with one rotor propelled by a water pump and pulled through the pipeline by cables or tug boat. Support equipment for this is very expensive including a heavy lift crane, large pumps and winches.

Yet another prior deposit removal method involves a device called a pig which, for large diameter pipes, may weigh up to 40,000 lbs. The pig is pushed through the pipe by low pressure, high volume water. It has scrapers that horizontally scrape the deposits off the walls. Heavy duty support equipment and much manpower is needed to carry out this method and the operation is very expensive.

A need exists for improving the removal of solid deposits from the inside surface of large diameter, cylindrical pipelines by providing new, more efficient machines for carrying out such operations and reducing the use of manual labor and costs in performing such cleaning operations.

OBJECTS

A principal object of the invention is the provision of improved devices useful for periodic cleaning from the inside walls of large diameter, cylindrical pipelines marine growths, or any other deposits, that accumulate over time to impede liquid flow through the pipelines.

Another object is the provision of such devices that do not require shut down of liquid flow through the pipeline to enable the cleaning to proceed.

A further object is the provision of such devices that employ liquid flow through the pipeline as a source of energy to carry out the cleaning operation.

Other objects and further scope of applicability of the present invention will become apparent from the detailed descriptions given herein; it should be understood, however, that the detailed description, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of improved devices for periodic cleaning from the inside wall of large diameter, cylindrical pipelines, marine growths or other deposits that impede liquid flow through the pipelines.

The new cleaning devices work by a rotating action causing steel scrapers or crushing rollers to come in contact with the pipeline wall and force the foreign material from it. The rotating action is produced by flow of water in the pipeline acting on rotor blades mounted on bearings. The device consists of a main frame to which wheels are mounted with air filled, rubber tires. Wide rotor blades are mounted forward of the wheels and specially designed spring return cutters or crusher rollers are mounted forward of the rotor blades. In preferred embodiments, the wheels are held above bottom center by a flotation device to allow them to straddle any accumulated debris build-up.

When the flow of water in the pipeline passes through the rotor blades, they spin and the resulting power is transmitted to the cutters or rollers, that due to centrifical force, tightly engage the inside surface of the pipeline. The device is constrained from the rear by appropriate size floating rope to regulate its forward progress. By way of example, if it is held stationary in an eight foot diameter pipeline with a flow of 67,000 gallons per minute, it will generate about 15 hp and with cutter blades properly angled, it will transit and clean the same area 240 times in one minute.

A main component of the new pipeline cleaning device is an elongated central shaft having a front end portion, a rear end portion and a central portion integrally joining the front end and rear end portions, all disposed along a longitudinal axis.

A cylindrical member is carried on the shaft front end portion in fixed longitudinal position relative to the shaft, but is free to rotate on bearings about the shaft front end portion concentric with the longitudinal axis.

At least two elongated standards extend laterally from the cylindrical member normal to the longitudinal axis and each standard is defined by an outer end portion, an inner end portion and a central portion, the standards being fixed by their the inner end portions to the cylindrical member.

Also included as essential parts are a plurality of planar rotor blades, equal in number to the number of the standards, each defined by a short inner end, a long arcuate outer end, and a pair of substantially equal length sides that form an obtuse angle with the inner end. Each blade is fixed to one of the standards by fastener means so its the inner end juxtaposes the inner end portion of its respective standard and holds the blade at an acute angle relative to the longitudinal axis of the central shaft.

Further, there are at least three rotatable, forward wheels fixed by strut means so all their axes of rotation are about an equal radial distance from the central shaft in a plane that is normal to the shaft's longitudinal axis and their plane of rotation passes through that longitudinal axis. The forward wheels are also fixed at about equal circumferential distances apart from each other.

In a rearward section of the device, there are a plurality of rotatable, rearward wheels that are equal in number to and mimic the forward wheels in radial and circumferential distances relative to each other and to the central shaft.

Finally, the new device includes a plurality of cleaner tools equal in number to the number of the standards, each pivotally carried upon one of the outer end portions of a respective standard by holder means that allows its associated cleaner tool to rotate outward from the longitudinal axis of the central shaft.

In preferred embodiments of the new devices of the invention, the number of the elongated standards is four, the numbers of the forward and rearward wheels are four and the cleaner tools are cutter blades or crusher rollers.

BRIEF DESCRIPTION OF THE DRAWINGS

A more complete understanding of the invention can be obtained by reference to the accompanying drawings in which:

In the drawings, FIGS. 3 & 4 are rotated 45° in order to improve illustration of the new cleaning devices of the invention.

DESCRIPTION OF THE PREFERRED EMBODIMENTS

Figure 1:
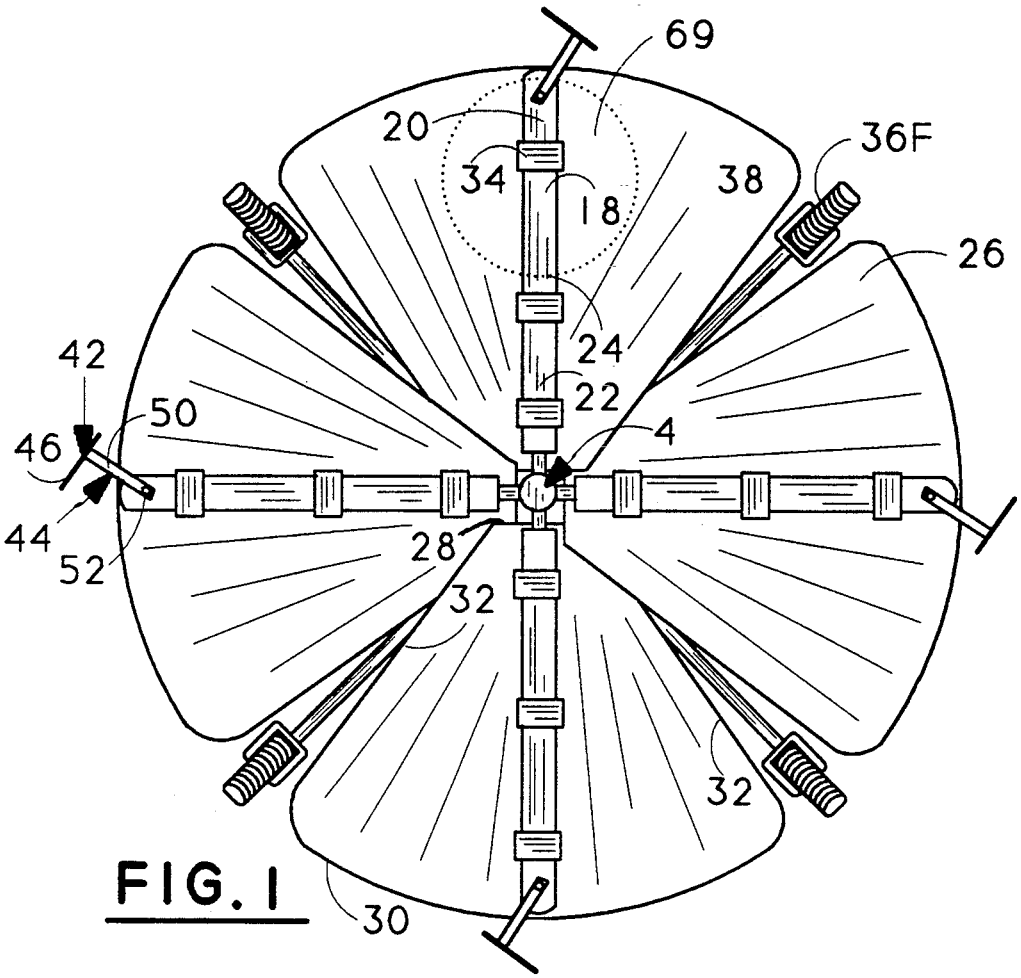
FIG. 1 is a front end view of a large diameter, cylindrical pipeline cleaning device constructed in accordance with the invention.

Referring in detail to the drawings, the cleaning device 2 of the invention comprises an elongated central shaft 4 having a front end portion 6, a rear end portion 8 and a central portion 10.

A cylindrical member 12 is carried on front end portion 6 fixed in longitudinal position relative to the shaft by the circular plate 14, but free to rotate on ball bearings 16 about the front end portion 6 concentric with the longitudinal axis of shaft 4.

Elongated standards 18 extend laterally from the cylindrical member 12 defined by a outer end portion 20, a inner end portion 22 and a central portion 24. Standards 18 are fixed to the cylindrical members 12 by being bolted to lugs 25 that extend laterally from member 12.

Rotor blades 26 have a short inner end 28, a long arcuate outer end 30, and a pair of substantially equal length sides 32 that each form an obtuse angle with the inner end 28. The blades are advantageously made of aluminum metal, but other sheet material, e.g., fiberglass sheet material, may be used. In a typical blade 26 for a device of the invention used to clean 8 ft diameter pipe, end 28 would be 9" wide, the end 30 would measure 5'6" across, the sides 32 would be 3'10" long and the radius of the curve in end 30 would be 7'8". Of course, these dimensions are exampliary only and will vary with the size of pipe to be cleaned, rate of water flow though the pipeline, etc.

Figure 3:
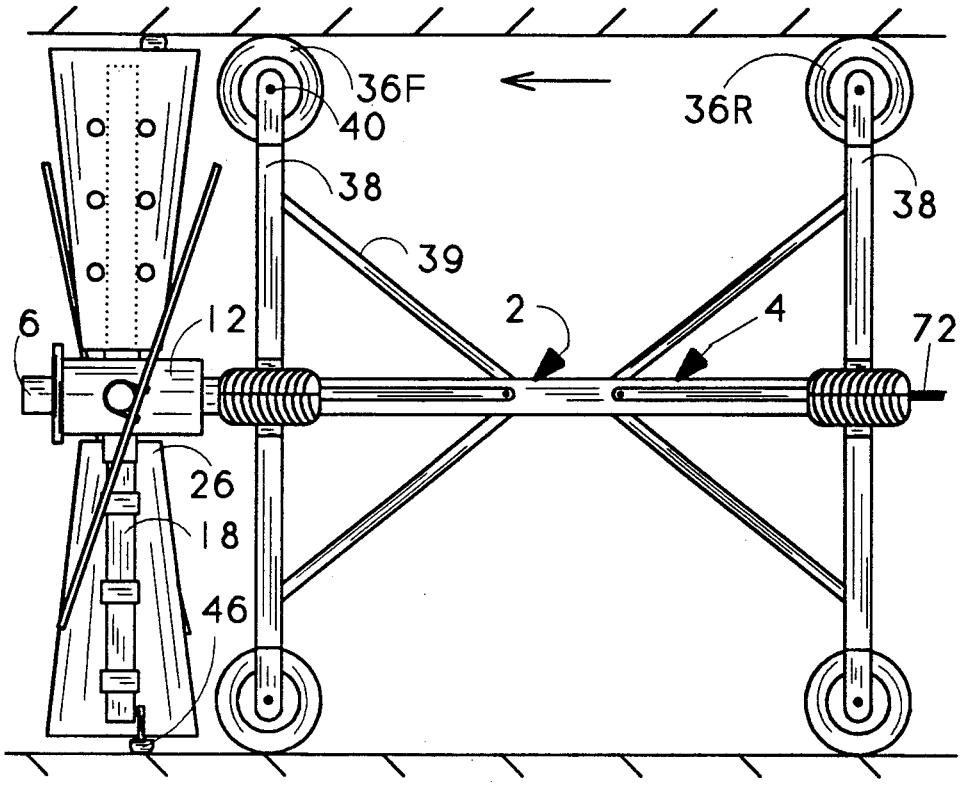
FIG. 3 is a lateral view corresponding to the front view of FIG. 2.
Figure 4:
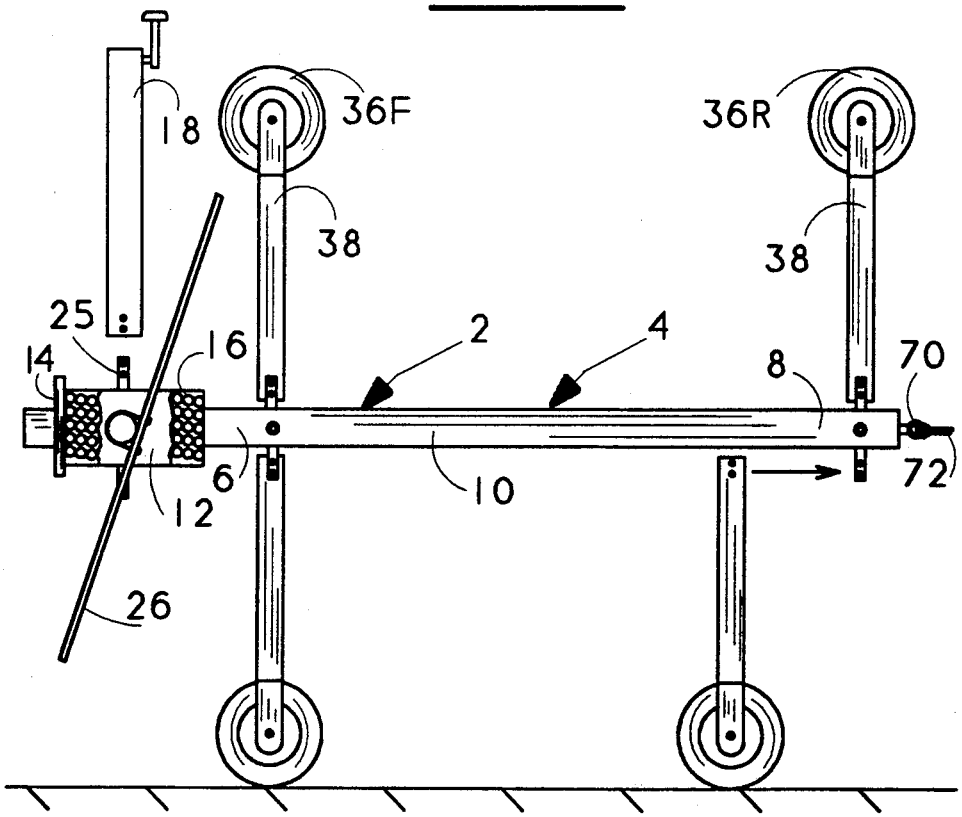
FIG. 4 is a partially sectional, lateral view of a partially assembled cleaning device of the invention.
Figure 5:
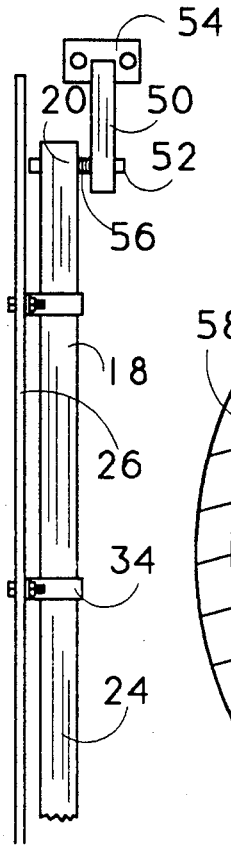
FIG. 5 is a fragmentary view of a rotor blade and supporting standard of the cleaning device of FIG. 1.
Figure 6:
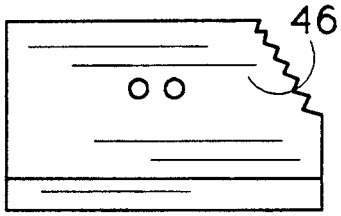
FIG. 6 is an enlarged plan view of a cutter blade of the cleaning device of FIG. 1.
Figure 7:
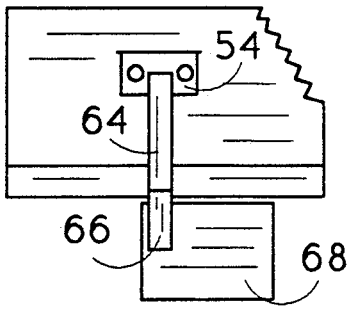
FIG. 7 is shows the cutter blade of FIG. 6 mounted on it pivoting blade holder with a depending torque stabilizer.
Figure 8:
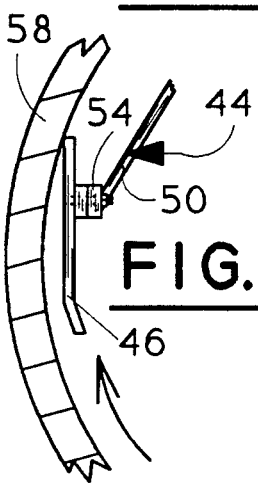
FIG. 8 is an enlarged front end, fragmentary, sectional view of a first embodiment of a cutter blade and its pivoted holder in accordance with the invention.
Figure 9:
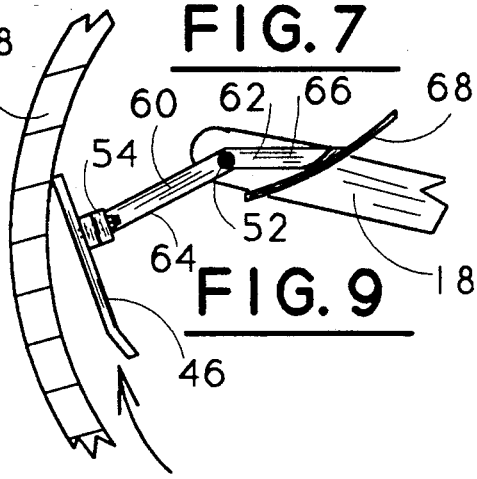
FIG. 9 is a fragmentary, sectional view similar to FIG. 8 of a second embodiment of a cutter blade and its pivoted holder in accordance with the invention.
Figure 10:
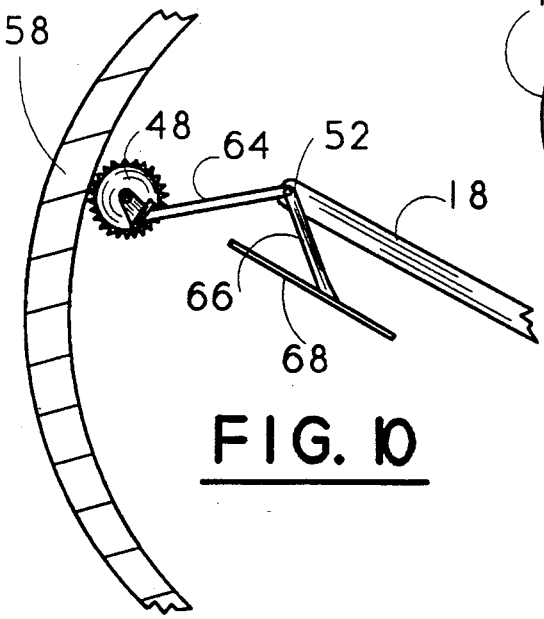
FIG. 10 is a fragmentary, sectional view similar to FIG. 9 showing a device of the invention with the cutter blade of FIG. 9 replaced with a crusher roller used to pulverize calcium and shell deposits from a pipeline.
Figure 11:
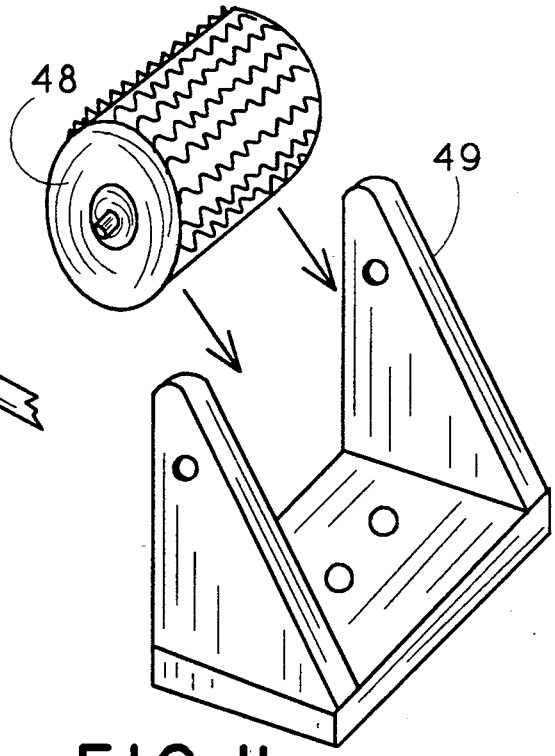
FIG. 11 is a exploded, enlarged view of the crusher roller and support bracket of FIG. 10.

Each blade 26 is fixed to one of the standards 18 by fastener means 34 so its the inner end 28 juxtaposes the inner end portion 22 of the respective standard 18 and holds the blade at an acute angle, e.g., 30° relative to the longitudinal axis of shaft 4 (see FIG. 3).

Forward wheels 36F are fixed by struts 38, assisted by brace members 39, so all their axles 40 are substantially an equal radial distance from the central shaft 4 and fixed at substantially equal circumferential distances apart from each other (see FIG. 1). The struts 38 may be made of two telescoping sections (not shown) to permit the wheels to be moved in or out to adjust the fit into a pipeline with corresponding change in size of the rotor blades 26.

The four rearward wheels 36R mimic the forward wheels 36F in radial and circumferential distances relative to each other and to the central shaft 4.

Cleaner tools 42 are pivotally carried upon the outer end portions 20 of the respective standard 18 by holder means 44 that biases the cleaner tools 42 to rotate inwardly so that when water flow through the pipeline is stopped and the blades 26 cease rotation, the cleaner tools will be pulled back from contact with the pipeline and make it easy to retreive the device 2.

The cleaner tools 42 may be cutter blades 46 or crusher rollers 48. The crusher rollers 48 are used to pulverize calcium crust and shell buildup on pipelines into small sized particles. The rollers 48 are rotatably carried in mounting blocks 49.

In one embodiment, holder means 44 comprises a simple arm 50 pivoted on a pin 52 that extends from the outer end 20 of a standard 18. The outer end of the arm 50 carries a mount plate 54 by which a cutter blade 46 or a crusher roller mounting block 49 may be bolted on the holder means 44. A coiled spring 56 is captured between the arm 50 and the standard 18 and serves to bias the blade 46 away from the inside surface of the pipeline 58.

In another embodiment, the holder means 44 comprises a crank arm 60 having a pivot portion 62, a first end portion 64 and a second end portion 66. The cutter blade 46 is fixed to first end portion and a counter torque stabilizer plate 68 is fixed, e.g., by welding, to the second end portion 66. The stabilizer plate serves to increase the force applied to the cutter blades 46 or crusher rollers 48 for removal of unwanted material from the pipeline inner wall. Thus, rotation of the rotor blades 26, which also causes forward motion of device 2, serves to exert opposing pressure on the counter torque stabilizer 68 which causes it to exert high pressure onto the cleaner tool 42 and make it cling tightly to the inner wall of the pipeline being cleaned. The mounting angle and weight of the stabilizer plate 68 will automatically release its pressure on the cleaner tool 42 when the flow of water in the pipeline 58 is stopped to allow retrieval of the device 2 when the cleaning job is completed.

The device 2 may include a buoyancy compensator 69 which serves to hold wheels 36F and 36R at an angle out of plumb permitting them to straddle any debris that accumulates during the cleaning operation. Such compensator may be any type of floation device anchored in any suitable manner to shaft 4 so that is buoyancy vector orientes wheels 36F and 36R into a position in which no wheel is on the lower end of the plumbline of the pipeline 58. Thus, in the preferred embodiment of the device 2 in which there are four wheels 36F and 36R, the compensator 69 will be constructed to hold the lower set of wheels 36F and 36R at 45° from the plumb line.

Figure 2:
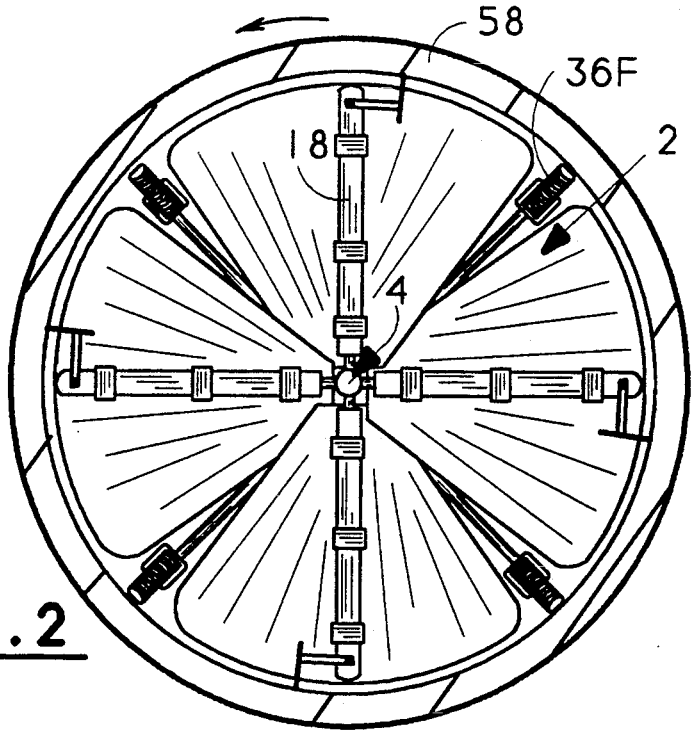
FIG. 2 is a reduced size, front end view of the cleaning device of FIG. 1 in cleaning position within a pipeline.

The rear end of the shaft 4 carries an eyebolt 70 to which a line 72 may be attached to control the movement of the device 2 within the pipeline 58. With the device 2 installed in a pipeline 58 (see FIG. 2) and water flowing in the direction indicated by the arrow in FIG. 3, the rotor blades will rotate in the direction indicated by the arrow in FIG. 2. As cleaning of the wall occurs, slow payout of line 72 will permit the device 2 to move slowly along the pipeline 58 to expose new portions of the pipeline inner wall to the action of cutter blades 46 or crusher rollers 48. When the total length of the pipeline 58 is cleaned, device 2 may be retrieved by pulling in the line 72.

I claim:

1. A device for periodic cleaning from the inside wall of large diameter, cylindrical pipelines marine growths or other deposits that impede liquid flow through said pipelines, said device comprising:

an elongated central shaft having a longitudinal axis and defined by a shaft front end portion, a shaft rear end portion and a shaft central portion integrally joining said shaft front end portion to said shaft rear end portion, a cylindrical member carried on said shaft front end portion in fixed longitudinal position relative to said shaft, but free to rotate about said shaft front end portion concentric with said longitudinal axis, at least two elongated standards that extend laterally from said cylindrical member normal to said longitudinal axis, each standard being defined by a standard outer end portion, a standard inner end portion and a standard central portion integrally joining said standard outer end portion to said standard inner end portion, said standards being fixed by their said inner end portions to said cylindrical member, a plurality of substantially planar rotor blades equal in number to the number of said standards, each defined by a short inner end, a long arcuate outer end, and a pair of substantially equal length sides that each form an obtuse angle with said inner end, each said blade being fixed to one of said standards by fastener means so its said inner end juxtaposes said inner end portion of the respective standard and holds said blade at an acute angle relative to said longitudinal axis, at least three rotatable, forward wheels fixed by strut means to said central shaft so all their axes of rotation are substantially an equal radial distance from said central shaft in a plane that is normal to said longitudinal axis and their plane of rotation passes through said longitudinal axis, said forward wheels being also fixed at substantially equal circumferential distances apart from each other, a plurality of rotatable, rearward wheels that are equal in number to and mimic said forward wheels in radial and circumferential distances relative to each other and to said central shaft, said forward and rearward wheels extending outwardly from said central shaft to contact the inside wall of a pipeline, and a plurality of cleaner tools equal in number to the number of said standards, each pivotally carried upon one of said outer end portions of a respective standard by holder means that allows its associated said cleaner tool to rotate outward from said longitudinal axis.

2. The device of claim 1 wherein the number of said elongated standards is four.

3. The device of claim 1 wherein the number of said forward wheels is four.

4. The device of claim 1 wherein said cleaner tools are cutter blades.

5. The device of claim 1 wherein said cleaner tools are crusher rollers.

6. A device for periodic cleaning from the inside wall of large diameter, cylindrical pipelines marine growths or other deposits that impede liquid flow through said pipelines, said device comprising:

an elongated central shaft having a longitudinal axis and defined by a shaft front end portion, a shaft rear end portion and a shaft central portion integrally joining said shaft front end portion to said shaft rear end portion, a cylindrical member carried on said shaft front end portion in fixed longitudinal position relative to said shaft, but free to rotate about said shaft front end portion concentric with said longitudinal axis, four elongated standards that extend laterally from said cylindrical member normal to said longitudinal axis, each standard being defined by a standard outer end portion, a standard inner end portion and a standard central portion integrally joining said standard outer end portion to said standard inner end portion, said standards being fixed by their said inner end portions to said cylindrical member, four substantially planar rotors, each defined by a short inner end, a long arcuate outer end, and a pair of substantially equal length sides that each form an obtuse angle with said inner end, each said blade being fixed to one of said standards by fastener means so its said inner end juxtaposes said inner end portion of the respective standard and holds said blade at an acute angle relative to said longitudinal axis, four forward wheels fixed by strut means to said central shaft so all their axes of rotation are substantially an equal radial distance from said central shaft in a plane that is normal to said longitudinal axis and their plane of rotation passes through said longitudinal axis, said forward wheels being also fixed at substantially equal circumferential distances apart from each other, four rotatable, rearward wheels that mimic said forward wheels in radial and circumferential distances relative to each other and to said central shaft, said forward and rearward wheels extending outwardly from said central shaft to contact the inside wall of a pipeline, and four cleaner tools each pivotally carried upon one of said outer end portions of a respective standard by holder means that allows its associated said cleaner tool to rotate outward from said longitudinal axis, said holder means comprising a crank arm defined by a pivot portion, a first end portion on one side of said pivot portion and a second end portion on the other side of said pivot portion, a cleaner tool carried on said first end portion and a counter torque stabilizer plate carried on said second end portion.

* * * * *